US009893433B2

(12) United States Patent
Cao et al.

(10) Patent No.: US 9,893,433 B2
(45) Date of Patent: Feb. 13, 2018

(54) ARRAY ANTENNA

(71) Applicant: Huawei Technologies Co., Ltd., Shenzhen (CN)

(72) Inventors: Chang Cao, Chengdu (CN); Fabio Morgia, Milan (IT); Uhland Goebel, Shenzhen (CN); Guoyu Su, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 63 days.

(21) Appl. No.: 15/178,646

(22) Filed: Jun. 10, 2016

(65) Prior Publication Data

US 2016/0301143 A1 Oct. 13, 2016

Related U.S. Application Data

(63) Continuation of application No. PCT/CN2014/084774, filed on Aug. 20, 2014.

(30) Foreign Application Priority Data

Dec. 13, 2013 (CN) ..... 2013 1 0690542

(51) Int. Cl.
*H01Q 13/10* (2006.01)
*H01Q 21/00* (2006.01)
(Continued)

(52) U.S. Cl.
CPC ..... *H01Q 21/0043* (2013.01); *H01P 5/12* (2013.01); *H01Q 13/18* (2013.01); *H01Q 21/005* (2013.01);
(Continued)

(58) Field of Classification Search
CPC .. H01Q 21/00; H01Q 21/0043; H01Q 21/005; H01Q 21/0093; H01Q 13/10; H01Q 13/18
See application file for complete search history.

(56) References Cited

U.S. PATENT DOCUMENTS 6,861,996 B2 * 3/2005 Jeong ..... H01Q 1/523 29/600
2012/0092224 A1 * 4/2012 Sauleau ..... H01Q 3/18 343/771
2012/0287006 A1 * 11/2012 Lenormand ..... H01Q 1/3275 343/771

FOREIGN PATENT DOCUMENTS

CN 101919118 A 12/2010
CN 201781067 U 3/2011
(Continued)

OTHER PUBLICATIONS

Miura, Y. et al., "A High-Efficiency Circularly-Polarized Aperture Array Antenna with a Corporate-Feed Circuit in the 60 GHz Band," IEICE Trans. Electron., vol. E94-C, No. 10, Oct. 2011, 8 pages.
(Continued)

*Primary Examiner* — Hoang Nguyen
(74) *Attorney, Agent, or Firm* — Slater Matsil, LLP

(57) ABSTRACT

The present disclosure provides an array antenna. The array antenna includes a cavity power divider that receives an input signal and performs power division to output a first power-divided signal. The array antenna also includes a final-stage power dividing, coupling, and radiating unit that includes a dielectric substrate and a first and a second metal surface layer. A coupling slot array is formed on the second metal surface layer to receive the first power-divided signal. A radiating slot array corresponding to the coupling slot array is formed on the first metal surface layer; Several plated through-hole units are provided on the dielectric substrate, where the plated through-hole units go through the
(Continued)

first and second metal surface layers vertically, and a range corresponding to each plated through-hole unit encloses a coupling slot and a radiating slot corresponding to the coupling slot.

20 Claims, 5 Drawing Sheets

(51) Int. Cl.
*H01Q 13/18* (2006.01)
*H01P 5/12* (2006.01)
*H01Q 21/06* (2006.01)

(52) U.S. Cl.
CPC ..... *H01Q 21/0006* (2013.01); *H01Q 21/0093* (2013.01); *H01Q 21/064* (2013.01)

(56) References Cited

FOREIGN PATENT DOCUMENTS

| | | | |
|---|---|---|---|
| CN | 102255138 | A | 11/2011 |
| CN | 103050776 | A | 4/2013 |
| CN | 103414030 | A | 11/2013 |
| CN | 203277632 | U | 11/2013 |
| CN | 203326117 | U | 12/2013 |
| WO | 2009061015 | A1 | 5/2009 |

OTHER PUBLICATIONS

Li, et al., "Axial Ratio Bandwidth Enhancement of 60-GHz Substrate Integrated Waveguide-Fed Circularly Polarized LTCC Antenna Array," IEEE Transactions on Antennas and Propagation, vol. 60, No. 10, Oct. 2012, pp. 4619-4626.

Xu, J. et al., "140-GHz TE20-Mode Dielectric-Loaded SIW Slot Antenna Array in LTCC," IEEE Transactions on Antenna and Propagation, vol. 61, No. 4, Apr. 2013, pp. 1784-1793.

Miura, Y. et al., "A 60 GHz Double-layer Waveguide Slot Array with more than 32 dBi and 80% Efficiency over 5GHz Bandwidth Fabricated by Diffusion Bonding of Laminated Thin Metal Plates," Jul. 2010, 4 pages.

* cited by examiner

ARRAY ANTENNA

CROSS-REFERENCE TO RELATED APPLICATIONS

This application is a continuation of International Application No. PCT/CN2014/084774, filed on Aug. 20, 2014, claims priority to Chinese Patent Application No. 201310690542.1, filed on Dec. 13, 2013, both of which are incorporated herein by reference in their entireties.

TECHNICAL FIELD

The present disclosure relates to the field of communications, and in particular, to an array antenna.

BACKGROUND

An antenna is one of the most important front-end passive components of a communications device. The antenna plays a very important role in performance of a communications product. Currently, an existing slot array antenna uses rows of through-holes provided on a surface of the slot array antenna to form a side wall of a rectangular waveguide, so that functions of a conventional rectangular waveguide are implemented. However, the antenna uses a serial feed. Due to constraints of the serial feed, bandwidth of the antenna is inversely proportional to a quantity of slots of each waveguide. Therefore, the antenna has narrow bandwidth, and cannot meet a requirement of a system for wider bandwidth.

SUMMARY

An array antenna is provided to increase bandwidth of an antenna and meet a requirement of a system for wider bandwidth.

According to a first aspect, an array antenna is provided and configured to receive an input signal and radiate the received input signal in a form of an electromagnetic signal. The array antenna includes a cavity power divider and a final-stage power dividing, coupling, and radiating unit assembled on the cavity power divider. The cavity power divider is configured to receive the input signal and perform power division on the input signal to output a first power-divided signal to the final-stage power dividing, coupling, and radiating unit. The final-stage power dividing, coupling, and radiating unit includes a dielectric substrate, a first metal surface layer disposed on an upper surface of the dielectric substrate, and a second metal surface layer disposed on a lower surface of the dielectric substrate. A coupling slot array is formed on the second metal surface layer to receive the first power-divided signal, a radiating slot array corresponding to the coupling slot array is formed on the first metal surface layer, and several plated through-hole units are provided on the dielectric substrate. The plated through-hole units go through the first and second metal surface layers vertically, and a range corresponding to each plated through-hole unit encloses a coupling slot in the coupling slot array and a radiating slot in the radiating slot array and corresponding to the coupling slot, so that final-stage power division is performed on the first power-divided signal received by the coupling slot array to output a second power-divided signal to the radiating slot array and that the radiating slot array radiates the second power-divided signal.

In a first possible implementation manner of the first aspect, the array antenna further includes a matching mechanical part, where the matching mechanical part is disposed between the cavity power divider and the final-stage power dividing, coupling, and radiating unit; the cavity power divider includes a waveguide port and a power-divided signal output port, where the waveguide port receives the input signal, so that the cavity power divider performs power division processing on the input signal, and the power-divided signal output port is configured to output the first power-divided signal; and the matching mechanical part includes a body part and a matching port formed on the body part, where the matching port corresponds to the power-divided signal output port and the coupling slot array, so that the power-divided signal output port is connected to a coupling slot of the final-stage power dividing, coupling, and radiating unit and that the first power-divided signal is transmitted to the coupling slot array.

With reference to the first possible implementation manner of the first aspect, in a second possible implementation manner, a quantity of the matching ports is the same as a quantity of the power-divided signal output ports and a quantity of the coupling slots in the coupling slot array, and sizes of the matching ports are the same as sizes of the power-divided signal output ports and sizes of the corresponding coupling slots in the coupling slot array.

In a third possible implementation manner of the first aspect, the array antenna further includes an isolating mechanical part, where the isolating mechanical part includes a board body and a through-hole array disposed on the board body; the through-hole array goes through a top and a bottom of the board body and corresponds to the radiating slot array; the bottom of the board body is disposed on the second metal surface layer; the through-hole array is interconnected with the radiating slot array; a projection of the radiating slot array on the board body is a first projection; and a projection of the through-hole array on the board body is a second projection, where the first projection overlaps the second projection or the first projection is within the second projection.

With reference to the third possible implementation manner of the first aspect, in a fourth possible implementation manner, both the radiating slot array and the through-hole array are 4×4 arrays, and the coupling slot array is a 2×2 array.

With reference to the third possible implementation manner of the first aspect, in a fifth possible implementation manner, the isolating mechanical part, the final-stage power dividing, coupling, and radiating unit, and the cavity power divider are assembled by using positioning pins.

With reference to the third possible implementation manner of the first aspect, in a sixth possible implementation manner, all through-holes in the through-hole array have a same size.

With reference to the third possible implementation manner of the first aspect, in a seventh possible implementation manner, the board body is made of a metallic material.

With reference to the third possible implementation manner of the first aspect, in an eighth possible implementation manner, the board body is made of a non-metallic material, and all hole walls of the through-hole array are coated with a metal layer.

In a ninth possible implementation manner of the first aspect, the dielectric substrate, the first metal surface layer, and the second metal surface layer are all in a square shape and have a same size.

The array antenna provided according to each implementation manner is configured to receive an input signal and radiate the received input signal in a form of an electromagnetic signal. The array antenna includes a cavity power divider and a final-stage power dividing, coupling, and radiating unit installed on the cavity power divider, where the cavity power divider is configured to receive the input signal and perform power division on the input signal to output a first power-divided signal to the final-stage power dividing, coupling, and radiating unit; and the final-stage power dividing, coupling, and radiating unit includes a dielectric substrate, a first metal surface layer disposed on an upper surface of the dielectric substrate, and a second metal surface layer disposed on a lower surface of the dielectric substrate, a coupling slot array is formed on the second metal surface layer to receive the first power-divided signal, a radiating slot array corresponding to the coupling slot array is formed on the first metal surface layer, and several plated through-hole units are provided on the dielectric substrate, where the plated through-hole units go through the first and second metal surface layers vertically, and a range corresponding to each plated through-hole unit encloses a coupling slot in the coupling slot array and a radiating slot in the radiating slot array and corresponding to the coupling slot, so that final-stage power division is performed on the first power-divided signal received by the coupling slot array to output a second power-divided signal to the radiating slot array and that the radiating slot array radiates the second power-divided signal. Because the cavity power divider is a shunt-fed power division feed and each plated through-hole unit of the final-stage power dividing, coupling, and radiating unit encloses a coupling slot in the coupling slot array and a radiating slot in the radiating slot array and corresponding to the coupling slot, a quantity of radiating slots corresponding to each final-stage power division is relatively small, so that the bandwidth of the array antenna is relatively wide, thereby meeting a requirement of a system for wider bandwidth. In addition, the dielectric substrate, the first metal surface layer, and the second metal surface layer of the final-stage power dividing, coupling, and radiating unit constitute a printed circuit board. Therefore, an objective of integrating functions of coupling, final-stage power dividing, and radiating is achieved by using the printed circuit board, availability is high, and costs are reduced.

BRIEF DESCRIPTION OF THE DRAWINGS

To describe the technical solutions in the embodiments of the present disclosure more clearly, the following briefly introduces the accompanying drawings required for describing the embodiments or the prior art. Apparently, the accompanying drawings in the following description show merely some embodiments of the present disclosure, and a person of ordinary skill in the art may still derive other drawings from these accompanying drawings without creative efforts.

DETAILED DESCRIPTION OF ILLUSTRATIVE EMBODIMENTS

The following clearly describes the technical solutions in the embodiments of the present disclosure with reference to the accompanying drawings in the embodiments of the present disclosure. Apparently, the described embodiments are merely some but not all of the embodiments of the present disclosure. All other embodiments obtained by a person of ordinary skill in the art based on the embodiments of the present disclosure without creative efforts shall fall within the protection scope of the present disclosure.

Figure 1:
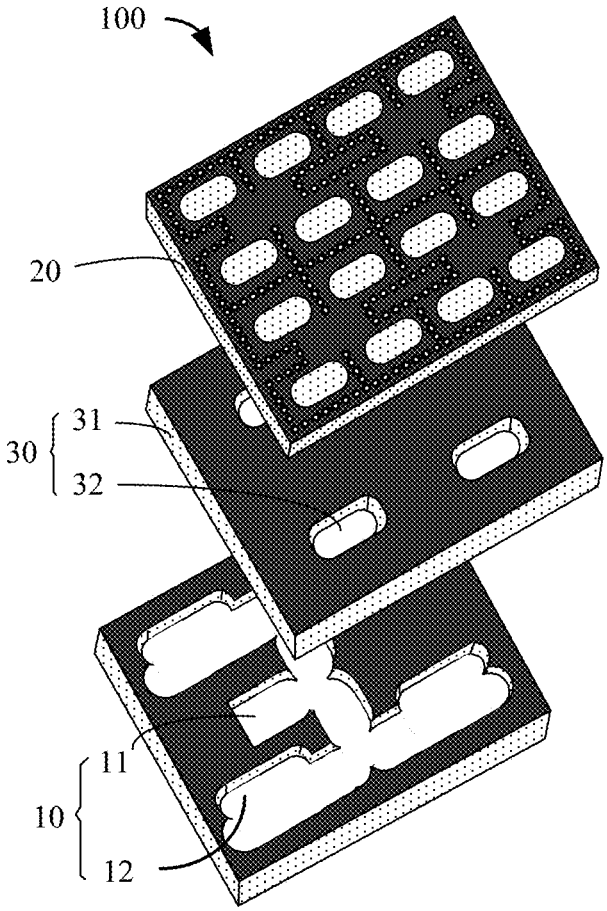
FIG. 1 is a schematic breakdown diagram of an array antenna according to a first exemplary implementation manner.
Figure 2:
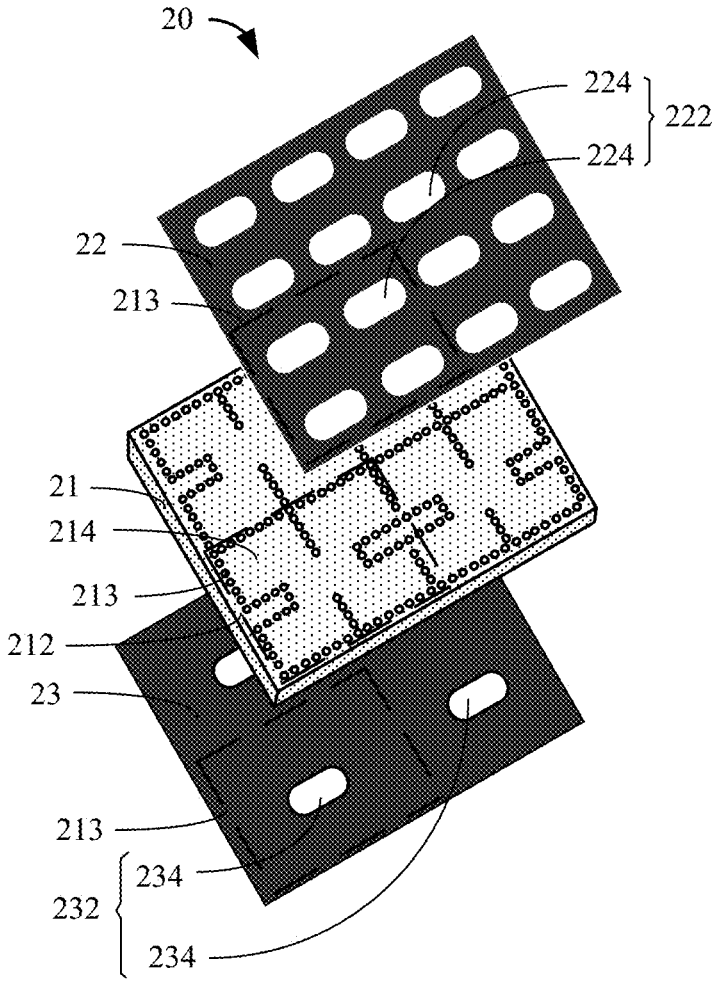
FIG. 2 is a top view of a final-stage power dividing, coupling, and radiating unit in FIG. 1.

Referring to FIG. 1, a first exemplary implementation manner of the present disclosure provides an array antenna 100. The array antenna 100 is configured to receive an input signal, and radiate the received input signal in a form of an electromagnetic signal. The array antenna 100 includes a cavity power divider 10 and a final-stage power dividing, coupling, and radiating unit 20 installed on the cavity power divider 10. The cavity power divider 10 is configured to receive the input signal, and perform power division on the input signal to output a first power-divided signal to the final-stage power dividing, coupling, and radiating unit 20. Referring to FIG. 2, the final-stage power dividing, coupling, and radiating unit 20 includes a dielectric substrate 21, a first metal surface layer 22 disposed on an upper surface of the dielectric substrate 21, and a second metal surface layer 23 disposed on a lower surface of the dielectric substrate 21. A coupling slot array 232 is formed on the second metal surface layer 23 to receive the first power-divided signal. A radiating slot array 222 corresponding to the coupling slot array 232 is formed on the first metal surface layer 22. Several plated through-hole units 212 are provided on the dielectric substrate 21. The plated through-hole units 212 go through the first metal surface layer 22 and the second metal surface layer 23 vertically. A range 214 corresponding to each plated through-hole unit 212 encloses a coupling slot 234 in the coupling slot array 232 and a radiating slot 224 in the radiating slot array 222 and corresponding to the coupling slot 234, so that final-stage power division is performed on the first power-divided signal received by the coupling slot array 232 to output a second power-divided signal to the radiating slot array 222 and that the radiating slot array 222 radiates the second power-divided signal.

The plated through-holes 212 provided on the dielectric substrate 21 and going through the first metal surface layer 22 and the second metal surface layer 23 enable the final-stage power dividing, coupling, and radiating unit 20 to implement final-stage power division with an equal amplitude and an equal phase and a symmetry in both an X-axis direction and a Y-axis direction. The X axis and Y axis are two axes of an X-Y coordinate system that is established on the surface of the dielectric substrate 21 and by using a center of the dielectric substrate 21 as an origin. The array antenna 100 is a PCB (printed circuit board) slot array antenna. The final-stage power dividing, coupling, and radiating unit 20 is a final-stage power dividing, coupling, and radiating unit of a PCB. The dielectric substrate 21, the first metal surface layer 22, and the second metal surface layer 23 constitute the PCB. Therefore, the final-stage power dividing, coupling, and radiating unit 20 achieves an objective of integrating the coupling, final-stage power dividing, and radiating by using the PCB.

In this implementation manner, the plated through-hole unit 212 is enclosed by several plated through-holes 213. The range 214 corresponding to the plated through-hole unit 212 is enclosed by the several plated through-holes 213. A quantity of the plated through-hole units 212 is four. The radiating slot array 222 is a 4×4 array, and the coupling slot array 232 is a 2×2 array. That is, one coupling slot 234 corresponds to four radiating slots 224, and the range 214 corresponding to one plated through-hole unit 212 encloses one coupling slot 234 and four radiating slots 224 corresponding to the coupling slot 234. Therefore, the final-stage power dividing, coupling, and radiating unit 20 implements final-stage one-to-four power division with an equal amplitude and an equal phase. The dielectric substrate 21, the first metal surface layer 22, and the second metal surface layer 23 are in a square shape and have a same size.

In other implementation manners, the radiating slot array 222 may also be an N×N array, where N is a natural number. However, the N×N array is extended on a basis of a most basic 2×2 subarray unit, for example, 4×4 and 8×8. That is, one coupling slot may correspond to a quantity of radiating slots that is equal to an integer multiple of 2, namely, 2N. In this way, one plated through-hole unit 212 may also enclose one coupling slot and 2N radiating slots corresponding to the coupling slot. Therefore, the final-stage power dividing, coupling, and radiating unit 20 can implement final-stage one-to-2N power division with an equal amplitude and equal phase. The type of the cavity power divider 10 may also be replaced according to an actual requirement, that is, the cavity power divider 10 may be replaced with another cavity power divider according to a requirement provided that it can implement a power division function. The shapes and sizes of the dielectric substrate 21, the first metal surface layer 22, and the second metal surface layer 23 may be adjusted according to an actual requirement, for example, may be circular or in an irregular shape.

In this implementation manner, the final-stage power dividing, coupling, and radiating unit 20 includes a dielectric substrate 21, a first metal surface layer 22 disposed on an upper surface of the dielectric substrate 21, and a second metal surface layer 23 disposed on a lower surface of the dielectric substrate 21. A coupling slot array 232 is formed on the second metal surface layer 23 to receive the first power-divided signal. A radiating slot array 222 corresponding to the coupling slot array 232 is formed on the first metal surface layer 22. Several plated through-hole units 212 are provided on the dielectric substrate 21. The plated through-hole units 212 go through the first metal surface layer 22 and the second metal surface layer 23 vertically. A range corresponding to each plated through-hole unit 212 encloses a coupling slot 234 in the coupling slot array 232 and a radiating slot 224 in the radiating slot array 222 and corresponding to the coupling slot 234, so that final-stage power division is performed on the first power-divided signal received by the coupling slot array 232 to output a second power-divided signal to the radiating slot array 222 and that the radiating slot array 222 radiates the second power-divided signal. Because the cavity power divider 10 is a shunt-fed power division feed and each plated through-hole unit 212 of the final-stage power dividing, coupling, and radiating unit 20 encloses a coupling slot 234 in the coupling slot array 232 and a radiating slot 224 in the radiating slot array 222 and corresponding to the coupling slot 234, a quantity of radiating slots 224 corresponding to each final-stage power division is relatively small, so that the bandwidth of the array antenna is relatively wide, thereby meeting a requirement of a system for wider bandwidth. In addition, the dielectric substrate 21, the first metal surface layer 22, and the second metal surface layer 23 of the final-stage power dividing, coupling, and radiating unit 20 constitute a PCB. Therefore, the final-stage power dividing, coupling, and radiating unit 20 achieves an objective of integrating functions of coupling, final-stage power dividing, and radiating by using the PCB, availability is high, and costs are reduced.

Further, referring to FIG. 1, the array antenna 100 further includes a matching mechanical part 30. The matching mechanical part 30 is disposed between the cavity power divider 10 and the final-stage power dividing, coupling, and radiating unit 20. The cavity power divider 10 includes a waveguide port 11 and a power-divided signal output port 12. The waveguide port 11 receives the input signal, so that the cavity power divider 10 performs power division processing on the input signal. The power-divided signal output port 12 is configured to output the first power-divided signal. The matching mechanical part 30 includes a body part 31 and a matching port 32 formed on the body part 31. The matching port 32 corresponds to the power-divided signal output port 12 and the coupling slot array 232, so that the power-divided signal output port 12 is connected to a coupling slot 234 of the final-stage power dividing, coupling, and radiating unit 20 and that the first power-divided signal is transmitted to the coupling slot array 232.

A quantity of the matching ports 32 is the same as a quantity of the power-divided signal output ports 12 and a quantity of the coupling slots 234 in the coupling slot array 232, and a size of the matching ports 32 is the same as a size of the power-divided signal output ports 12 and a size of the corresponding coupling slots 234 in the coupling slot array 232. The matching mechanical part 30 may be made of a conducting material, for example, a metallic material. The matching mechanical part 30 may also be made of a non-conducting material, but the matching port in the matching mechanical part 30 is coated with a conducting material, for example, a metallic material.

Figure 3:
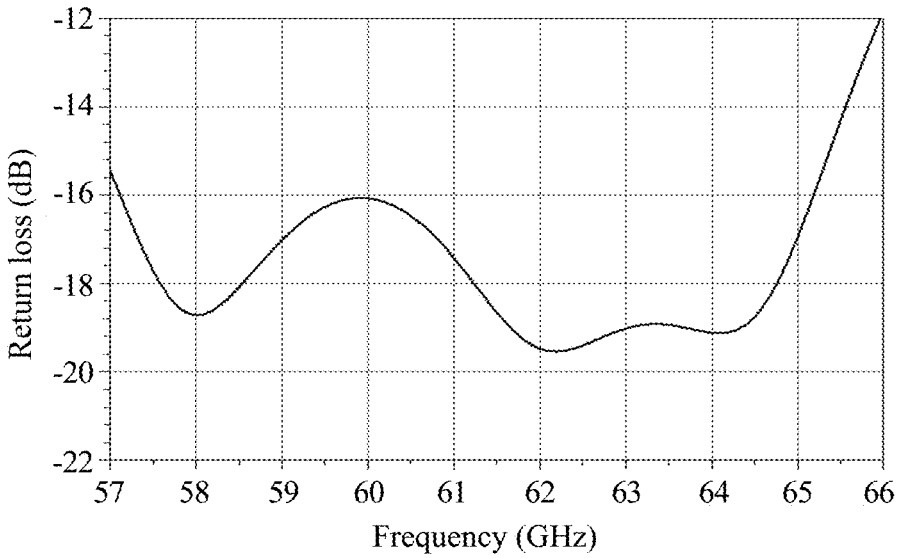
FIG. 3 is a diagram of a simulated voltage standing wave ratio after a matching mechanical part is removed from the array antenna in FIG. 1.
Figure 4:
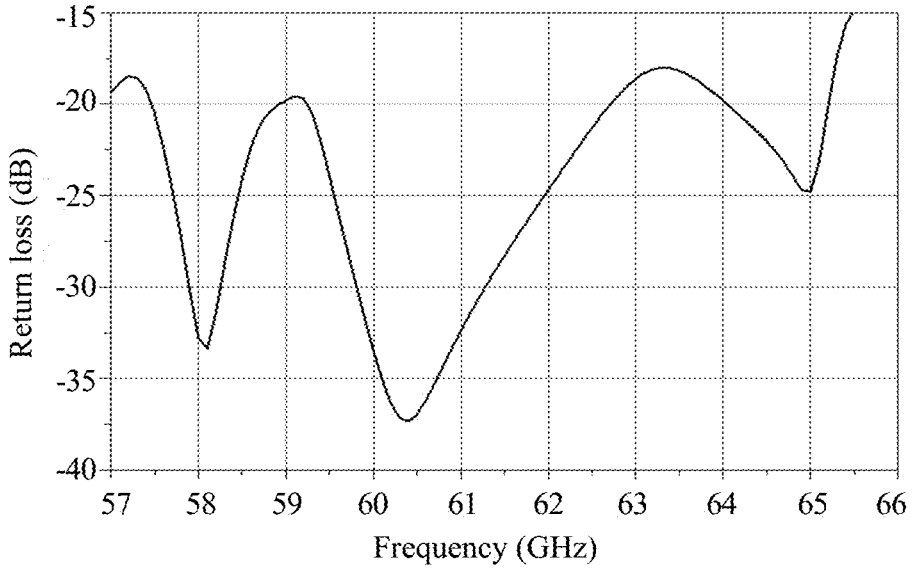
FIG. 4 is a diagram of a simulated voltage standing wave ratio of the array antenna in FIG. 1.

Referring to FIG. 3 and FIG. 4, in this implementation manner, the matching mechanical part 30 is disposed between the cavity power divider 10 and the final-stage power dividing, coupling, and radiating unit 20. The matching port 32 corresponds to the power-divided signal output port 12 and the coupling slot array 232, so that the power-divided signal output port 12 is connected to a coupling slot 234 of the final-stage power dividing, coupling, and radiating unit 20 and that the first power-divided signal is transmitted to the coupling slot array 232. FIG. 3 is a simulated voltage standing wave ratio diagram obtained when simulation is performed after the matching mechanical part 14 is removed from the array antenna in FIG. 1. FIG. 4 is a simulated voltage standing wave ratio diagram obtained when simulation is performed on the array antenna according to the present disclosure. It can be known through comparison between FIG. 3 and FIG. 4 that the array antenna 100 in which the matching mechanical part 14 is disposed between the cavity power divider 10 and the final-stage power dividing, coupling, and radiating unit 20 has a relatively low voltage standing wave ratio. That is, the matching mechanical part 14 reduces the voltage standing wave ratio of the array antenna 100. Therefore, the bandwidth of the array antenna 100 is increased.

Figure 5:
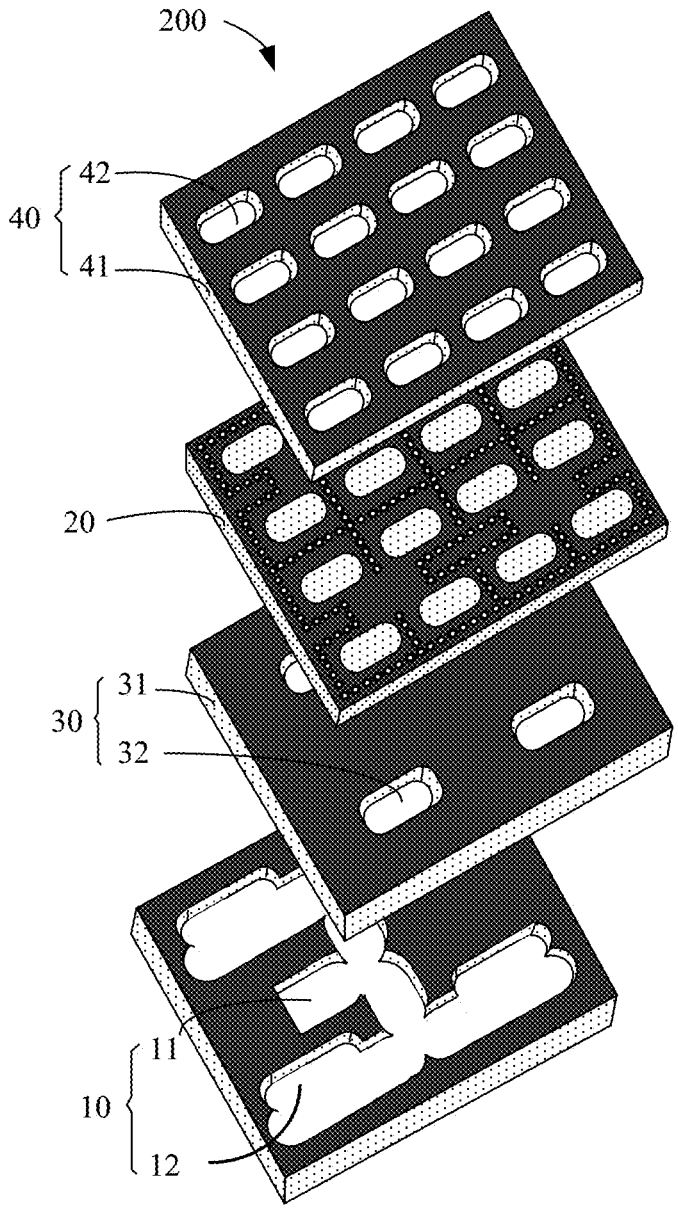
FIG. 5 is a schematic breakdown diagram of an array antenna according to a second exemplary implementation manner.

Referring to FIG. 5, a second exemplary implementation manner of the present disclosure provides an array antenna 200. The array antenna 200 provided according to the second exemplary implementation manner is similar to the array antenna provided according to the first exemplary implementation manner, with a difference in that in the second exemplary implementation manner, the array antenna 200 further includes an isolating mechanical part 40. The isolating mechanical part 40 includes a board body 41 and a through-hole array 42 disposed on the board body 41. The through-hole array 42 goes through a top and a bottom of the board body 41 and corresponds to the radiating slot array 222. The bottom of the board body 41 is disposed on the second metal surface layer 23. The through-hole array 42 is interconnected with the radiating slot array 232. A projection of the radiating slot array 232 on the board body 41 is a first projection. A projection of the through-hole array 42 on the board body 41 is a second projection. The first projection overlaps the second projection or the first projection is within the second projection. The through-hole array 42 is configured to isolate each radiating slot 224 in the radiating slot array 232 to prevent the radiating slots 224 from affecting each other and avoid an impact on signal quality.

The through-hole array 42 is a 4×4 array. The isolating mechanical part 40, the final-stage power dividing, coupling, and radiating unit 20, and the cavity power divider 10 are assembled by using positioning pins. All through-holes in the through-hole array 42 have a same size. The through-holes are in a square shape. The board body is made of a metallic material.

In other implementation manners, the form of the through-hole array 42 may be changed according to a change of the radiating slot array 232. The shape of the through-hole may also be adjusted according to an actual requirement, for example, adjusted to a circular or horn shape. The board body 41 may also be made of a non-metallic material.

Figure 6:
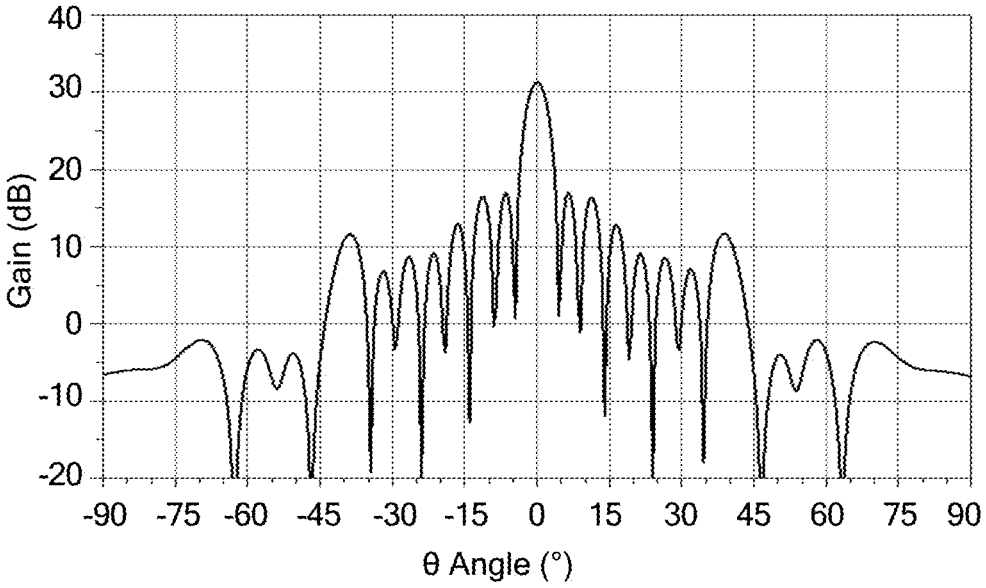
FIG. 6 is a diagram of a simulated radiation pattern after an isolating mechanical part is removed from the array antenna in FIG. 5.
Figure 7:
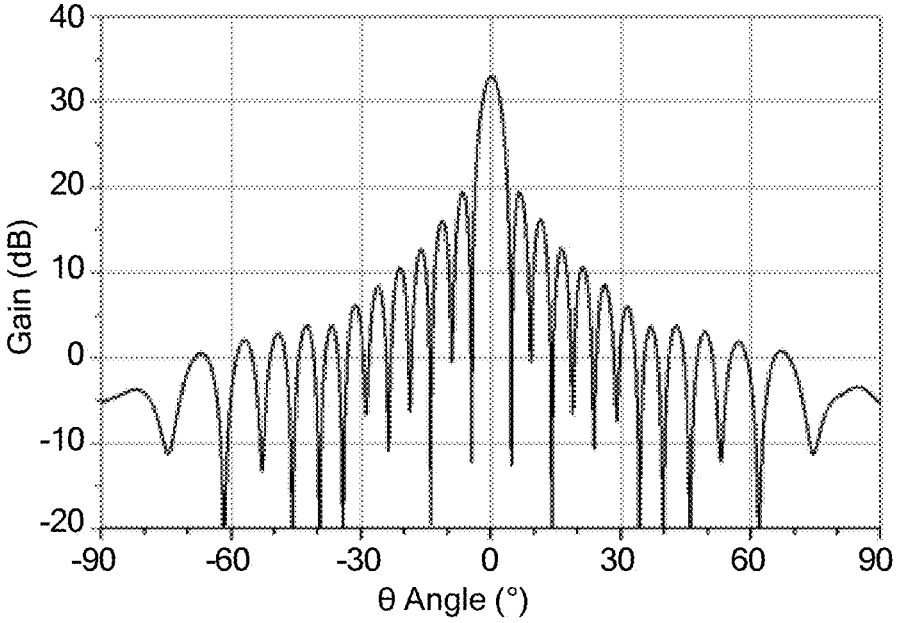
FIG. 7 is a simulated radiation pattern of the array antenna in FIG. 5.

Referring to FIG. 6 and FIG. 7, in this implementation manner, the through-hole array 42 on the isolating mechanical part 40 is disposed on the second metal surface layer 23. Each through-hole corresponds to one radiating slot 224, so that a surface current of each radiating slot 224 can be isolated and that couplings between the radiating slots 224 can be reduced. FIG. 6 is a simulated radiation pattern after the isolating mechanical part 40 is removed from the array antenna in FIG. 5. FIG. 7 is a simulated radiation pattern of the array antenna 200 according to the present disclosure. It can be known through comparison between FIG. 6 and FIG. 7 that in the radiation pattern of the array antenna 200 to which the isolating mechanical part 40 is added, a grating lobe and a sidelobe of the antenna are greatly improved. Therefore, a problem that a panel antenna generally has a higher grating lobe is solved.

What is disclosed above is merely exemplary embodiments of the present disclosure, and certainly is not intended to limit the protection scope of the present disclosure. A person of ordinary skill in the art may understand that all or some of processes that implement the foregoing embodiments and equivalent modifications made in accordance with the claims of the present disclosure shall fall within the scope of the present disclosure.

What is claimed is:

1. An array antenna, configured to receive an input signal and radiate the received input signal in a form of an electromagnetic signal;

wherein the array antenna comprises a cavity power divider and a final-stage power dividing, coupling, and radiating unit assembled on the cavity power divider;

wherein the cavity power divider is configured to receive the input signal and perform power division on the input signal to output a first power-divided signal to the final-stage power dividing, coupling, and radiating unit;

wherein the final-stage power dividing, coupling, and radiating unit comprises a dielectric substrate, a first metal surface layer disposed on an upper surface of the dielectric substrate, and a second metal surface layer disposed on a lower surface of the dielectric substrate, a coupling slot array is formed on the second metal surface layer to receive the first power-divided signal, a radiating slot array corresponding to the coupling slot array is formed on the first metal surface layer, and several plated through-hole units are provided on the dielectric substrate; and wherein the plated through-hole units go through the first and second metal surface layers vertically, and a range corresponding to each plated through-hole unit encloses a coupling slot in the coupling slot array and a radiating slot in the radiating slot array and corresponding to the coupling slot, so that final-stage power division is performed on the first power-divided signal received by the coupling slot array to output a second power-divided signal to the radiating slot array and that the radiating slot array radiates the second power-divided signal.

2. The array antenna according to claim 1, wherein the array antenna further comprises a matching mechanical part, wherein the matching mechanical part is disposed between the cavity power divider and the final-stage power dividing, coupling, and radiating unit;

wherein the cavity power divider comprises a waveguide port and a power-divided signal output port;

wherein the waveguide port receives the input signal, so that the cavity power divider performs power division processing on the input signal, and the power-divided signal output port is configured to output the first power-divided signal;

wherein the matching mechanical part comprises a body part and a matching port formed on the body part; and wherein the matching port corresponds to the power-divided signal output port and the coupling slot array, so that the power-divided signal output port is connected to a coupling slot of the final-stage power dividing, coupling, and radiating unit and that the first power-divided signal is transmitted to the coupling slot array.

3. The array antenna according to claim 2, wherein a quantity of the matching ports is the same as a quantity of the power-divided signal output ports and a quantity of the coupling slots in the coupling slot array, and sizes of the matching ports are the same as sizes of the power-divided signal output ports and sizes of the corresponding coupling slots in the coupling slot array.

4. The array antenna according to claim 1, further comprising an isolating mechanical part, wherein the isolating mechanical part comprises a board body and a through-hole array disposed on the board body;

wherein the through-hole array goes through a top and a bottom of the board body and corresponds to the radiating slot array;

wherein the bottom of the board body is disposed on the second metal surface layer;

wherein the through-hole array is interconnected with the radiating slot array;

wherein a projection of the radiating slot array on the board body is a first projection;

wherein a projection of the through-hole array on the board body is a second projection; and wherein the first projection overlaps the second projection or the first projection is within the second projection.

5. The array antenna according to claim 4, wherein both the radiating slot array and the through-hole array are 4×4 arrays and the coupling slot array is a 2×2 array.

6. The array antenna according to claim 4, wherein the isolating mechanical part, the final-stage power dividing, coupling, and radiating unit, and the cavity power divider are assembled using positioning pins.

7. The array antenna according to claim 4, wherein all through-holes in the through-hole array have a same size.

8. The array antenna according to claim 4, wherein the board body is made of a metallic material.

9. The array antenna according to claim 4, wherein the board body is made of a non-metallic material and all hole walls of the through-hole array are coated with a metal layer.

10. The array antenna according to claim 1, wherein the dielectric substrate, the first metal surface layer, and the second metal surface layer are all in a square shape and have a same size.

11. A method of forming an array antenna, the array antenna being configured to receive an input signal and radiate the received input signal in a form of an electromagnetic signal, the method comprising:

forming a cavity power divider, wherein the cavity power divider is configured to receive the input signal and perform power division on the input signal to output a first power-divided signal to a final-stage power dividing, coupling, and radiating unit;

assembling the final-stage power dividing, coupling, and radiating unit on the cavity power divider, the assembling comprising:

providing a dielectric substrate;

disposing a first metal surface layer on an upper surface of the dielectric substrate;

disposing a second metal surface layer on a lower surface of the dielectric substrate;

forming a coupling slot array on the second metal surface layer, the coupling slot array being configured to receive the first power-divided signal;

forming a radiating slot array corresponding to the coupling slot array on the first metal surface layer; and providing several plated through-hole units on the dielectric substrate, wherein the plated through-hole units go through the first and second metal surface layers vertically, and a range corresponding to each plated through-hole unit encloses a coupling slot in the coupling slot array and a radiating slot in the radiating slot array and corresponding to the coupling slot, so that final-stage power division is performed on the first power-divided signal received by the coupling slot array to output a second power-divided signal to the radiating slot array and that the radiating slot array radiates the second power-divided signal.

12. The method according to claim 11, further comprising:

disposing a matching mechanical part between the cavity power divider and the final-stage power dividing, coupling, and radiating unit, the matching mechanical part comprising a body part and a matching port formed on the body part;

wherein forming the cavity power divider comprises forming a waveguide port and a power-divided signal output port, the waveguide port being configured to receive the input signal, so that the cavity power divider performs power division processing on the input signal, and the power-divided signal output port being configured to output the first power-divided signal; and wherein the matching port corresponds to the power-divided signal output port and the coupling slot array, so that the power-divided signal output port is connected to a coupling slot of the final-stage power dividing, coupling, and radiating unit and that the first power-divided signal is transmitted to the coupling slot array.

13. The method according to claim 12, wherein a quantity of the matching ports is the same as a quantity of the power-divided signal output ports and a quantity of the coupling slots in the coupling slot array, and sizes of the matching ports are the same as sizes of the power-divided signal output ports and sizes of the corresponding coupling slots in the coupling slot array.

14. The method according to claim 11, further comprising forming an isolating mechanical part, wherein the isolating mechanical part comprises a board body and a through-hole array disposed on the board body;

wherein the through-hole array goes through a top and a bottom of the board body and corresponds to the radiating slot array;

wherein the bottom of the board body is disposed on the second metal surface layer;

wherein the through-hole array is interconnected with the radiating slot array;

wherein a projection of the radiating slot array on the board body is a first projection;

wherein a projection of the through-hole array on the board body is a second projection; and wherein the first projection overlaps the second projection or the first projection is within the second projection.

15. The method according to claim 14, wherein both the radiating slot array and the through-hole array are 4×4 arrays and the coupling slot array is a 2×2 array.

16. The method according to claim 14, wherein the isolating mechanical part, the final-stage power dividing, coupling, and radiating unit, and the cavity power divider are assembled using positioning pins.

17. The method according to claim 14, wherein all through-holes in the through-hole array have a same size.

18. The method according to claim 14, wherein the board body is made of a metallic material.

19. The method according to claim 14, wherein the board body is made of a non-metallic material and all hole walls of the through-hole array are coated with a metal layer.

20. The method according to claim 11, wherein the dielectric substrate, the first metal surface layer, and the second metal surface layer are all in a square shape and have a same size.

* * * * *